US007279826B2

(12) United States Patent
Ritz et al.

(10) Patent No.: US 7,279,826 B2
(45) Date of Patent: Oct. 9, 2007

(54) REFLECTOR LAMP WITH A PARTIALLY REFLECTIVE BURNER

(75) Inventors: Arnd Ritz, Heinsberg (DE); Holger Mönch, Vaals (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 33 days.

(21) Appl. No.: 10/507,182

(22) PCT Filed: Mar. 7, 2003

(86) PCT No.: PCT/IB03/00840

§ 371 (c)(1),
(2), (4) Date: Sep. 9, 2004

(87) PCT Pub. No.: WO03/077282

PCT Pub. Date: Sep. 18, 2003

(65) Prior Publication Data

US 2005/0218769 A1 Oct. 6, 2005

(30) Foreign Application Priority Data

Mar. 13, 2002 (DE) ..... 102 11 015

(51) Int. Cl.
*H01J 5/16* (2006.01)
*H01J 61/40* (2006.01)
*F21V 7/00* (2006.01)

(52) U.S. Cl. ..... 313/114; 313/113; 313/635; 362/297; 362/346

(58) Field of Classification Search ..... 313/113, 313/114, 635; 362/297, 346
See application file for complete search history.

(56) References Cited

U.S. PATENT DOCUMENTS

| | | | | |
|---|---|---|---|---|
| 4,345,178 | A * | 8/1982 | Pappas et al. | 313/113 |
| 5,587,626 | A * | 12/1996 | Parham et al. | 313/634 |
| 5,646,473 | A * | 7/1997 | Eggink et al. | 313/113 |
| 5,675,677 | A * | 10/1997 | Davenport et al. | 385/31 |
| 5,676,579 | A * | 10/1997 | Parham et al. | 445/58 |
| 6,168,297 | B1 * | 1/2001 | Tatsukawa | 362/351 |
| 6,304,693 | B1 * | 10/2001 | Buelow et al. | 362/298 |
| 6,967,443 | B2 * | 11/2005 | Bigio et al. | 313/635 |

FOREIGN PATENT DOCUMENTS

| | | |
|---|---|---|
| DE | 1015267 A1 | 4/2003 |
| EP | 1180719 A | 2/2002 |
| FR | 2713825 A1 | 6/1995 |

* cited by examiner

*Primary Examiner*—Nimeshkumar D. Patel
*Assistant Examiner*—Peter Macchiarolo

(57) ABSTRACT

A reflector lamp is described which consist essentially of a light source, in particular in the form of a high-pressure gas discharge lamp (HID [high intensity discharge] lamp or UHP [ultra high performance] lamp), as well as a main or secondary reflector (12), and a primary reflector (25) by means of which light from the light source (22) can be reflected through the light source (22) onto the main reflector (12). The primary reflector (25) is arranged such that those regions of the main reflector (12) are obscured which are optically inactivated regions, for example because of a lead-through and/or a fastening device for the lamp, which have no reflection properties, or which have reflection properties that adversely affect the radiation characteristic of the reflector lamp. The reflector lamp is particularly suitable for projection applications because of its high luminous efficacy. Furthermore, a substantially automated and accordingly cost-effective assembly of the lamp is possible.

17 Claims, 2 Drawing Sheets

REFLECTOR LAMP WITH A PARTIALLY REFLECTIVE BURNER

The invention relates to a reflector lamp which is formed essentially by a light source, in particular in the form of a high-pressure gas discharge lamp (HID [high intensity discharge] lamp or UHP [ultra high performance] lamp), a main reflector (secondary reflector), and a primary reflector by means of which light from the light source is reflected onto the main reflector.

Reflector lamps of this kind are used by preference inter alia for projection purposes because of their optical properties and are described, for example, in DE 101 51 267.8. Features essential for this application are in particular a luminous efficacy which is as high as possible and a radiation characteristic which is as even as possible in illuminating the projection surface.

A problem that may counteract an optimization of these properties is formed, for example, by fastening elements and/or lead-throughs for the lamp in the main reflector, which will have the result that the light issuing from the light source is partly obscured and/or is incident on regions which are not reflecting or which have reflection properties which adversely affect the radiation characteristic of the reflector lamp.

It is useful in this connection to distinguish between the reflector portion, which has a certain, optically active shape and supports the main reflector (reflecting layer), and a neck portion which serves primarily for fastening the lamp and for passing through supply lines. The two portions form the reflector body which has a reflector opening or light emission opening.

During mounting, the lamp must be aligned in the reflector body in accordance with the shape of the main reflector and then fixed in the correct position (for example with lamp cement) so as to achieve optimum optical properties or a certain radiation characteristic.

The neck portion is dimensioned such that the accommodated lamp can be correctly aligned. This must be done while taking into account on the one hand the manufacturing tolerances of the reflector body and the lamp and on the other hand the fact that the actual light source, i.e. the discharge arc in a discharge lamp, will not occupy an exactly defined and reproducible position in the discharge space for reasons of manufacturing technology. Therefore, the discharge arc must be brought into the focus of the reflector, i.e. into the optimum position, while being optically checked and while the lamp is burning. This means that the diameter or opening of the neck portion must be so large that sufficient space is available for adjusting the lamp.

It is also required, however, that the diameter of this neck portion, i.e. of the opening thereof, should be as small as possible for optical reasons, so as not to lose too much of the surface area available for the reflector. This is true in particular for the case in which the lamp is inserted comparatively deeply into the reflector and thus comes very close to the rear end of the reflector. In a usual parabolic reflector with a focal distance of approximately 7.5 mm and a lamp whose discharge vessel has a diameter of approximately 9 mm, the discharge vessel will be at a distance of no more than approximately 3 mm from the reflector surface. A comparatively large spatial angle of the light radiation is accordingly associated with a comparatively small reflector surface area, so that a correspondingly large light loss may be occasioned thereby. It is for this reason that a maximum difference between the diameter of the rearmost opening in the reflector reserved for the lamp and the diameter of the lamp is generally allowed to be approximately 1 mm, so that the space available for mounting and adjustment is still comparatively small.

The required small opening of the neck portion also renders an automation of the adjustment and mounting more difficult. The lamp must be held by its rear end so as to be capable of alignment in the operational position, which means that the lamp must either be introduced into the reflector body through the neck portion, which is usually not possible given the small neck portion diameter, or it must be gripped by its front end for inserting into the light emission opening of the reflector and then gripped again by its rear end. Both alternatives require a considerable mechanical expenditure, which is further increased by the introduction and the comparatively slow curing of the lamp cement.

A further problem is that the rearmost portion of the reflector body, and in particular of the reflector portion, may be manufactured with a less exact geometric shape than the front portion, which lies in the region of the light emission window. The reason for this is that the wall thicknesses are greater in the rear portion of the reflector body, and that the neck portion and suitable fastening elements are also to be formed there. Such a geometric inaccuracy may be very disadvantageous because every irregularity in the rear reflector portion has a comparatively wide spatial angle associated with it, so that it has a much stronger influence on the radiation characteristic than an irregularity in the front reflector portion.

The invention accordingly has for its object to provide a reflector lamp of the kind mentioned in the opening paragraph whose optical properties are adversely affected to a substantially lower degree, or not at all, by said rear portions of the reflector portion and/or other objects in the reflector portion.

Furthermore, the invention has for its object to provide a reflector lamp which can be mounted and aligned automatically, and accordingly inexpensively, with a comparatively small mechanical expenditure, without the necessity of choosing a construction in which a portion of the effective reflector surface is no longer available.

A further object is to provide a reflector lamp which can be miniaturized considerably more strongly without substantial light losses than is possible for known reflector lamps.

These and other objects are achieved by means of a reflector lamp with a light source, a main or secondary reflector, and at least one primary reflector which is provided for an at least substantial reflection through the light source onto the main reflector of those light portions originating from the light source which propagate in the direction of optically inactivated regions of the main reflector or regions of the main reflector obscured by other objects.

Optically inactivated regions are understood to be those regions which have no reflection properties or reflection properties which adversely affect the radiation characteristic of the reflector lamp, such as, for example, the opening of a neck portion in the main reflector and possibly an edge of this opening. The degree of reflection of said light portions is then essentially dependent on the reflectivity of the chosen reflector material and on the accuracy of the shape and position of the primary reflector.

A particular advantage of this solution is that the reflector lamp is suitable in particular for projection purposes, because the reflection of the kind mentioned above does not appreciably increase the extent (i.e. substantially the width of the radiation characteristic) of the light source, so that no adaptation problems will arise in the insertion into a projection optical system, even if the primary reflector has comparatively large dimensions.

Furthermore, the influence of optically inactivated regions on the radiation characteristic of the reflector lamp is at least largely eliminated also if these regions (for example in the form of a neck portion) are made comparatively large in comparison with known reflector lamps so as to render possible an automated mounting of a lamp comprising the light source, and/or to achieve a high degree of miniaturization without substantial light losses by means of an at least partial positioning of the lamp in the neck portion, and/or to be able to use mechanical fastening means for the lamp instead of lamp cement, which means have the further advantage that they enable a substantially more accurate, reliable, and secure fastening of the lamp.

Finally, a disadvantageous influence on the radiation characteristic by objects in the region of the main reflector, such as, for example, fastening elements, cooling means, etc., can be avoided with the invention in that a (possibly further) primary reflector is positioned so as to take account of the positions and dimensions of said objects.

Further advantageous included eliminating adverse influences of the optically inactivated regions or other objects.

The primary reflectors may be manufactured in a particularly simple, effective, and inexpensive manner.

Other advantages include rendering possible a particularly high degree of miniaturization of the reflector lamp, which may be used to particular advantage in projection applications because of the intensity and composition of the radiated light.

Further particulars, features, and advantages of the invention will become apparent from the following description of preferred embodiments, which is given with reference to the drawing, in which.

Identical or corresponding components have been given the same reference numerals in FIGS. 1 to 3.

Figure 1:
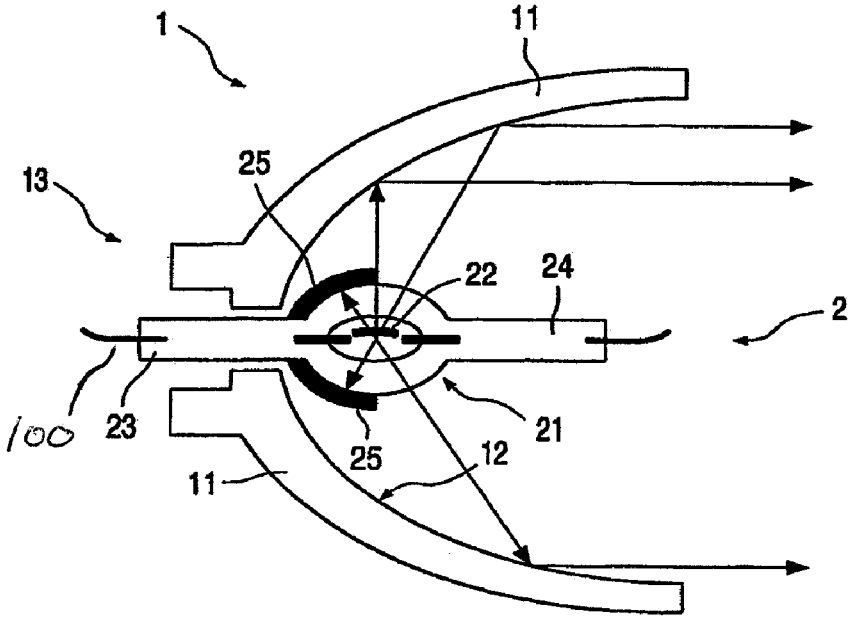
FIG. 1 is a diagrammatic longitudinal sectional view of a first embodiment.

The reflector lamps according to the invention are composed of a reflector body 1 and a lamp 2 each time, as can be seen from these Figures.

The reflector body 1 comprises on the one hand the reflector portion 11 which carries on its inner wall a reflector surface (main or secondary reflector) 12 in the form of an optically reflecting layer. The inner wall is shaped such that the light of the lamp 2 issues from the light emission opening of the reflector body 1 with a desired radiation characteristic. In general, this shape has a parabolic gradient (parabolic mirror), but ellipse-type and other shapes are alternatively possible, which shapes are chosen in dependence on the nature of a beam generation required for a given application.

The optically reflecting layer is formed, for example, by a metal layer or by single or multiple dielectric layers lying on top of one another.

On the other hand, the reflector body 1 comprises a neck portion, which serves essentially for accommodating and fixing the lamp 2, at its rear end opposite to the light emission opening.

The lamp 2 shown in the present case is a gas discharge lamp which comprises a burner 21 with a discharge space in which the arc discharge constituting the actual light source 22 is excited between two electrodes, as well as a first and a second lamp end 23, 24 through which a supply current is introduced. At least the first lamp end 23 extends through the neck portion 13 of the reflector body 1 for fixation of the lamp 2. An exposed electrode 100 extends out of the first lamp end 23.

Alternatively, an incandescent lamp or some other light source may be used.

Figure 2:
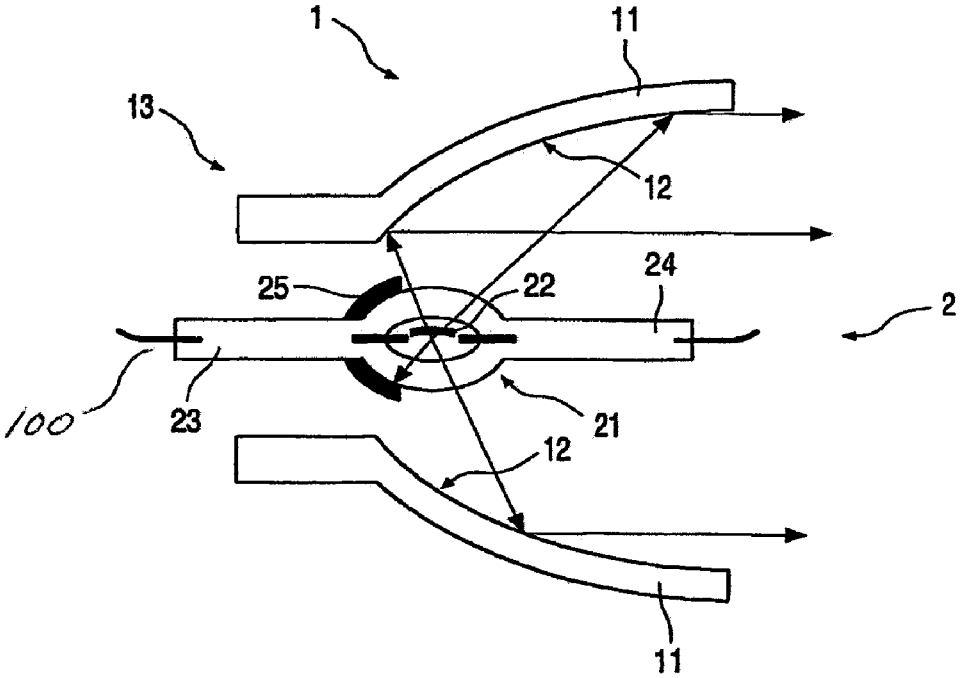
FIG. 2 is a diagrammatic longitudinal sectional view of a second embodiment.
Figure 3:
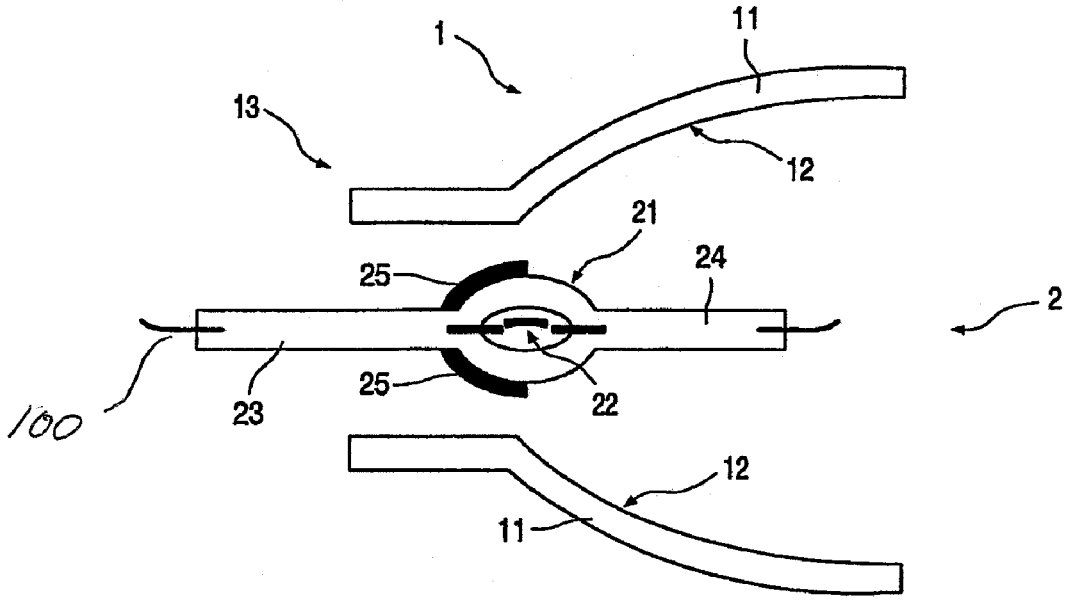
FIG. 3 is a diagrammatic longitudinal sectional view of a third embodiment.

As can be seen in FIGS. 1 to 3, furthermore, the burner 21 of the lamp 2 is provided at its surface with an optically reflecting layer (primary reflector) 25 which, like the reflector surface 12, is formed, for example, by a metal layer or a number of superimposed dielectric layers (multilayer dichroic filter), and which is provided by known coating processes.

The layer or coating 25 here lies on the rearmost half of the burner 21, i.e. on the portion adjoining the opening of the neck portion 13, and extends in forward direction (in the direction of light radiation), for example as shown in FIGS. 1 and 3, up to the "equator" of the burner 21, i.e. up to approximately the level of the geometric center of the light source 22 (arc discharge or incandescent coil).

This coating 25 thus renders the optical function of the rearmost or obscured portion of the reflector surface 12 at least substantially redundant. The negative influence of the comparatively low optical quality of the rearmost portion of the reflector surface 12 on the radiation characteristic of the reflector lamp is thus also at least substantially eliminated.

Among the results of this is that the size of the opening of the neck portion 13 is no longer critical with respect to the losses at the reflector surface 12 mentioned above, and may accordingly be made so large in particular that the lamp 2 can be introduced into the reflector body 1 from behind, while sufficient space is available for its alignment. This also opens up the possibility of an automated assembly and adjustment with comparatively little expenditure.

Furthermore, the rear end of the reflector body 1 can also be dimensioned considerably more freely, so that, for example, suitable mechanically adjustable fastening elements can be used for the lamp 2 instead of lamp cement.

The surface provided with the coating 25 is advantageously shaped such that the light originating from the light source 22 and incident on the coating 25 is at least substantially reflected towards itself and is accordingly aimed through the light source 22 onto the reflector surface 12. This back reflection has the further advantage that the extension of the light source 22 is not increased by the reflection at the coating 25, i.e. the radiation characteristic of the light source is not substantially widened, so that in particular in projection systems no additional adaptation problems will arise in the insertion into the optical projection system.

In the first embodiment of the invention shown in FIG. 1, the diameter of the neck portion 13 is dimensioned such that the lamp 2 can be adjusted and fastened with its first lamp end 23 therein in the required manner, but in this case it is inserted into the neck portion in conventional manner through the light emission opening of the reflector body 1. The coating 25 in this embodiment extends on the surface of the burner 21 between the start of the first lamp end 23 situated in the neck portion 13 and approximately the "equator" of the burner 21, which lies approximately at the level of the geometric center of the light source 22.

In the embodiments shown in FIGS. 2 and 3, the neck portion 13 has a diameter such that the lamp 2 can be inserted through this neck portion 13, i.e. from behind into the reflector body 1.

In the second embodiment of FIG. 2, there is also a portion of the burner 21 situated inside the neck portion 13, and the reflecting coating 25 extends from the start of the first lamp end 22 lying inside the neck portion 13 only so far in the direction of the light emission opening of the reflector body 1 that it optically replaces the opening of the neck portion 13 and possibly the region of the reflector surface 12 immediately surrounding this opening, which region may have insufficient optical properties.

It also becomes apparent from these embodiments that the rear portion of the reflector surface 12, which surrounds the opening of the (comparatively narrow) neck portion 13, is optically no longer necessary because of the coating 25.

In the third embodiment shown in FIG. 3, it is not only the first lamp end 22, but also approximately half the burner 21 which lies inside the neck portion 13 of the reflector body 1, such that the geometric (virtual) continuation of the reflector surface 12 extends through the burner 21.

The second and in particular the third embodiment have the further advantage that the focal distance of the reflector portion 11 and the diameter of the burner 21 may be chosen substantially independently of one another. This renders possible a further miniaturization of the reflector lamp for substantially the same light catchment efficiency compared with known reflector lamps, in which the focal distance of the reflector portion 11 must be greater than the radius of the burner 21 so as to avoid light losses.

All embodiments furthermore provide the possibility of providing the reflecting coating 25 asymmetrically, and in particular non-rotationally-symmetrically on the surface of the burner 21. This may be useful in particular if further components such as, for example, mounting elements, lamp contacts, ignition aids such as antennas, or cooling devices, etc., are present inside the reflector body 1 next to the lamp 2. In such a case the edge of the coating 25 could run such that said components are obscured, while the coating 25 reflects the light back onto itself and aims it through the light source 22 onto the free regions of the reflector surface 12.

Alternatively, a further primary reflector in the form of a local coating on the burner surface may be arranged so as to correspond to the positions and dimensions of these objects.

Preferred combinations of the primary and secondary reflectors are disclosed in the cited publication DE 101 51 267.8, which is incorporated in the present disclosure by reference. Various reflecting coatings and materials are described therein, from which materials the coatings are preferably composed so as to achieve their desired optical properties (for example dichroically reflecting coatings) and to achieve coefficients of thermal expansion which correspond as closely as possible to those of the material of the reflector portion 11 and the burner 21, as applicable. These materials are in particular $SiO_2$, $TiO_2$, and/or $ZrO_2$, and/or $Ta_2O_5$.

The invention claimed is:

1. A reflector lamp with a light source contained within a hollow discharge vessel having an extended end that starts at said hollow discharge vessel and extends outward, an exposed electrode extending out of the end, a main reflector, a neck portion extending from said main reflector, and at least one primary reflector which is configured to provide a reflection through the light source onto the main reflector of those light portions originating from the light source which propagate in a direction of optically inactivated regions of the main reflector or regions of the main reflector obscured by other objects, wherein the at least one primary reflector covers a portion of the hollow discharge vessel but does not mostly cover the end, and wherein the end extends in the direction of the optically inactivated regions of the main reflector.

2. The reflector lamp as claimed in claim 1, wherein said optically inactivated regions are formed by a through passage in the main reflector which is provided for a lamp comprising the light source.

3. The reflector lamp as claimed in claim 1, wherein said objects are fastening means, cooling means, ignition means, or other means provided for activating and/or operating the light source.

4. The reflector lamp as claimed in claim 1, wherein the primary reflector is formed by an optically reflecting coating which is provided on a surface of a lamp comprising the light source.

5. The reflector lamp as claimed in claim 4, wherein the optically reflecting coating is formed by a metal layer or by a plurality of dielectric layers or dichroic filters.

6. The reflector lamp as claimed in claim 1, further comprising a reflector body with a reflector portion supporting the main reflector, said neck portion being configured for introducing a lamp comprising the light source, such that the geometric continuation of the main reflector passes through a burner of the lamp.

7. The reflector lamp as claimed in claim 1, further comprising a reflector body with a reflector portion supporting the main reflector, said neck portion being configured for introducing a lamp comprising the light source.

8. The reflector lamp as claimed in claim 1, wherein the light source is an arc discharge in a high-pressure gas discharge lamp.

9. A projection system with at least one reflector lamp as claimed in claim 1.

10. A lamp comprising:

a substantially ellipsoid-shaped discharge vessel configured to sustain a discharge;

a vessel reflector at least partially covering said substantially ellipsoid-shaped discharge vessel;

a reflection portion covered with a further reflector; and a neck portion extending from said reflection portion;

wherein at least a portion of said substantially ellipsoid-shaped discharge vessel is located within said neck portion, wherein said ellipsoid-shaped discharge vessel has an extended end that starts at said ellipsoid-shaped discharge vessel and extends outward, wherein an exposed electrode extends out of said end, wherein said vessel reflector covers a portion of said substantially ellipsoid-shaped discharge vessel but does not mostly cover said end, and wherein said end extends in the direction of said neck portion.

11. The lamp of claim 10, wherein at least a portion of said vessel reflector is located within said neck portion.

12. The lamp of claim 10, wherein a geometric continuation of the further reflector passes through the discharge vessel.

13. A lamp comprising:

a substantially ellipsoid-shaped envelope configured to include a light source;

an envelope reflector at least partially covering said substantially ellipsoid-shaped envelope;

a reflection portion covered with a further reflector; and a neck portion extending from said reflection portion;

wherein at least a portion of said substantially ellipsoid-shaped envelope is located within said neck portion, wherein said ellipsoid-shaped envelope has an extended end that starts at said ellipsoid-shaped envelope and extends outward, wherein an exposed electrode extends out of the end, wherein said envelope reflector covers a portion of said substantially ellipsoid-shaped envelope but does not mostly cover said end, and wherein said end extends in a direction of said neck portion.

14. The lamp of claim 13, wherein at least a portion of said envelope reflector is located within said neck portion.

15. The lamp of claim 13, wherein a geometric continuation of the further reflector passes through the envelope.

16. The lamp of claim 10, wherein the end extends in a direction of optically inactivated regions of the further reflector.

17. The lamp of claim 13, wherein the end extends in a direction of optically inactivated regions of the further reflector.

* * * * *